US008910727B2

(12) United States Patent
Bar-Cohen et al.

(10) Patent No.: US 8,910,727 B2
(45) Date of Patent: Dec. 16, 2014

(54) ULTRASONIC/SONIC JACKHAMMER

(75) Inventors: Yoseph Bar-Cohen, Seal Beach, CA (US); Stewart Sherrit, La Crescenta, CA (US); Jack L. Herz, Weston, CT (US)

(73) Assignee: California Institute of Technology, Pasadena, CA (US)

( * ) Notice: Subject to any disclaimer, the term of this patent is extended or adjusted under 35 U.S.C. 154(b) by 768 days.

(21) Appl. No.: 11/700,575

(22) Filed: Jan. 31, 2007

(65) Prior Publication Data

US 2007/0193757 A1 Aug. 23, 2007

Related U.S. Application Data

(60) Provisional application No. 60/765,153, filed on Feb. 3, 2006.

(51) Int. Cl.
*B25D 11/00* (2006.01)
*B25D 11/06* (2006.01)

(52) U.S. Cl.
CPC ..... *B25D 11/064* (2013.01); *B25D 11/00* (2013.01); *B25D 2250/311* (2013.01); *Y10S 173/02* (2013.01)
USPC ..... 173/90; 173/142; 173/DIG. 2; 310/314; 310/317; 310/323.18; 310/323.01; 310/311; 310/25

(58) Field of Classification Search
CPC ..... B25D 11/00; B25D 11/064
USPC ..... 173/90, 142, DIG. 2; 310/314, 317, 310/323.18, 311, 323.01; 175/56, 404, 405, 175/414, 416, 389
See application file for complete search history.

(56) References Cited

U.S. PATENT DOCUMENTS

| | | | | |
|---|---|---|---|---|
| 1,528,812 | A | | 3/1925 | Binnie et al. |
| 1,656,526 | A | | 1/1928 | Lincoln |
| 2,851,251 | A | | 9/1958 | Mori |
| 2,903,242 | A | | 9/1959 | Bodine, Jr. |
| 2,946,314 | A | | 7/1960 | Nast |
| 3,148,293 | A | * | 9/1964 | Jones et al. ..... 310/26 |
| 3,352,369 | A | | 11/1967 | Bodine, Jr. |
| 3,431,988 | A | | 3/1969 | Bodine, Jr. |
| 3,584,327 | A | * | 6/1971 | Murry ..... 15/104.16 |
| 3,595,133 | A | | 7/1971 | Foster |

(Continued)

OTHER PUBLICATIONS

JPL's NDEAA Ultrasonic-Sonic Driller—Corer (USDC) Homepage at http://ndeaa.ipl.nasa.gov-nasa-nde-usdc-usdc.htm (printed on Jun. 26, 2007, 4 pgs.).

(Continued)

*Primary Examiner* — Michelle Lopez
(74) *Attorney, Agent, or Firm* — Milstein Zhang & Wu LLC; Duan Wu, Esq.

(57) ABSTRACT

The invention provides a novel jackhammer that utilizes ultrasonic and/or sonic vibrations as source of power. It is easy to operate and does not require extensive training, requiring substantially less physical capabilities from the user and thereby increasing the pool of potential operators. An important safety benefit is that it does not fracture resilient or compliant materials such as cable channels and conduits, tubing, plumbing, cabling and other embedded fixtures that may be encountered along the impact path. While the ultrasonic/sonic jackhammer of the invention is able to cut concrete and asphalt, it generates little back-propagated shocks or vibrations onto the mounting fixture, and can be operated from an automatic platform or robotic system.

36 Claims, 7 Drawing Sheets

(56) References Cited

U.S. PATENT DOCUMENTS

| | | | | | |
|---|---|---|---|---|---|
| 3,619,671 | A | | 11/1971 | Shoh | |
| 3,624,760 | A | | 11/1971 | Bodine | |
| 3,645,344 | A | * | 2/1972 | Bodine | 173/49 |
| 3,683,470 | A | | 8/1972 | McMaster et al. | |
| 3,780,926 | A | * | 12/1973 | Davis | 228/1.1 |
| 3,800,889 | A | | 4/1974 | Bauer | |
| 3,808,820 | A | | 5/1974 | Bodine | |
| 3,889,166 | A | * | 6/1975 | Scurlock | 318/116 |
| 3,900,826 | A | | 8/1975 | Dowling et al. | |
| 3,901,075 | A | | 8/1975 | Hampton et al. | |
| 4,033,419 | A | | 7/1977 | Pennington | |
| 4,036,309 | A | | 7/1977 | Petreev et al. | |
| 4,223,744 | A | | 9/1980 | Lovingood | |
| 4,319,716 | A | | 3/1982 | Lauer | |
| 4,457,174 | A | | 7/1984 | Bar-Cohen et al. | |
| 4,660,573 | A | * | 4/1987 | Brumbach | 606/128 |
| 4,721,107 | A | * | 1/1988 | Bolg et al. | 606/128 |
| 4,817,712 | A | | 4/1989 | Bodine | |
| 4,828,052 | A | | 5/1989 | Duran et al. | |
| 4,838,853 | A | | 6/1989 | Parisi | |
| 5,115,717 | A | | 5/1992 | Roemer | |
| 5,301,758 | A | | 4/1994 | Jenne | |
| 5,377,551 | A | | 1/1995 | Vacquer | |
| 5,411,106 | A | | 5/1995 | Maissa et al. | |
| 5,417,290 | A | | 5/1995 | Barrow | |
| 5,549,170 | A | | 8/1996 | Barrow | |
| 5,568,448 | A | * | 10/1996 | Tanigushi et al. | 367/82 |
| 5,595,243 | A | | 1/1997 | Maki et al. | |
| 5,597,345 | A | | 1/1997 | Young | |
| 5,816,342 | A | | 10/1998 | Prater et al. | |
| 5,828,156 | A | * | 10/1998 | Roberts | 310/317 |
| 5,890,553 | A | | 4/1999 | Bar-Cohen et al. | |
| 5,976,314 | A | * | 11/1999 | Sans | 156/580.1 |
| 5,984,023 | A | | 11/1999 | Sharma et al. | |
| 6,092,421 | A | | 7/2000 | Bar-Cohen et al. | |
| 6,105,695 | A | | 8/2000 | Bar-Cohen et al. | |
| 6,204,592 | B1 | | 3/2001 | Hur | |
| 6,247,367 | B1 | | 6/2001 | Bar-Cohen et al. | |
| 6,406,429 | B1 | | 6/2002 | Bar-Cohen et al. | |
| 6,498,421 | B1 | | 12/2002 | Oh et al. | |
| 6,550,549 | B2 | | 4/2003 | Myrick | |
| 6,617,760 | B1 | | 9/2003 | Peterson et al. | |
| 6,689,087 | B2 | * | 2/2004 | Pal et al. | 604/22 |
| 6,731,047 | B2 | * | 5/2004 | Kauf et al. | 310/317 |
| 6,856,072 | B2 | * | 2/2005 | Kosaka et al. | 310/323.02 |
| 6,863,136 | B2 | | 3/2005 | Bar-Cohen et al. | |
| 6,968,910 | B2 | | 11/2005 | Bar-Cohen et al. | |
| 7,156,189 | B1 | | 1/2007 | Bar-Cohen et al. | |
| 7,387,612 | B2 | * | 6/2008 | Pal et al. | 601/2 |
| 2004/0007387 | A1 | | 1/2004 | Bar-Cohen et al. | |
| 2004/0047485 | A1 | | 3/2004 | Sherrit et al. | |

OTHER PUBLICATIONS

Bar-Cohen. "*Miniature Low-Power Ultrasonic Core Driller (UTCD)*," Graphs of a presentation on ultrasonic drilling at the Feb. 22, 1998 TRIWG Review (3 pgs.).

Bar-Cohen. "Ultrasonic Drilling and Coring," Graphss of a presentation to the NASA Space Mechanisms Working Group, Dec. 15, 1998 (9 pgs.).

Sherrit, et al. "*Modeling of Horns for Sonic/Ultrasonic Applications*," IEEE International Ultrasonics Symposium, held in Lake Tahoe, CA, Oct. 17-20, 1999, pp. 647-651 (5 pgs.).

Sherrit, et al. "*Comparison of the Mason and KLM Equivalent Circuits for Piezoelectric Resonators in the Thickness Mode*," IEEE International Ultrasonics Symposium, held in Lake Tahoe, CA, Oct. 17-20, 1999, pp. 621-626 (6 pgs.).

Bar-Cohen, et al. "*Ultrasonic/sonic drilling/coring (USDC)for in-situ planetary applications*," SPIE Smart Structures 2000, Mar. 2000, Newport Beach, CA, Paper 3992-101 (8 pgs.).

Sherrit, et al. "*Analysis of the Impedance Resonance of Piezoelectric Stacks*," Proceedings of the IEEE Ultrasonics Symposium in San Juan, Puerto Rico, Oct. 22-25, 2000 (4 pgs.).

Sherrit, et al. "*Modeling of the Ultrasonic/Sonic Driller/Corer: USDC*," Proceedings of the IEEE Ultrasonics Symposium in San Juan, Puerto Rico, Oct. 22, 2000 (4 pgs.).

Bar-Cohen, et al."*Ultrasonic/Sonic Driller/Corer (USDC) as a Sampler for Planetary Exploration*," Proceedings of the 2001 IEEE Aerospace Conference on the topic of "Missions, Systems, and Instruments for In Situ Sensing" (Session 2.05), Big Sky, Montana, Mar. 10, 2000 (10 pgs.).

Bar-Cohen, et al. "*Ultrasonic/sonic drilling/coring (USDC) for planetary applications*," SPIE Symposium on Smart Structures 2001, Mar. 2001, Newport Beach, CA, paper 4327 (7 pgs.).

Sherrit, et al. "*Sample Acquisition and In-Situ Analysis Using the Ultrasonic-Sonic Driller/Corer (USDC) and Robotic Platforms*," The 6th International Symposium on Artificial Intelligence, Robotics and Automation in Space (iSAIRAS-01), Montreal, Canada, Jun. 18-21, 2001 (8 pgs.).

Sherrit, et al. "*Characterization of Transducers and Resonators under High Drive Levels*," IEEE International Ultrasonics Symposium, Atlanta, GA, Oct. 7-10, 2001 (4 pgs.).

Sherrit, et al. "*Novel Horn Designs for Ultrasonic/Sonic Cleaning Welding, Soldering, Cutting and Drilling*," Paper 4701-34, Proceedings of the SPIE Smart Structures and Materials Symposium, San Diego, CA, Mar. 17-19, 2002 (8 pgs.).

Chang, et al. "*Modeling of particle flow due to ultrasonic drilling*," Paper 4701-35, Proceedings of the SPIE Smart Structures Conference, San Diego, CA., Mar. 19, 2002 (7 pgs.).

Bao, et al. "*Analysis and Simulation of the Ultrasonic/Sonic Driller/Corer(USDC)*," Paper 4701-36, Proceedings of the SPIE Smart Structures Conference, San Diego, CA., Mar. 2002 (11 pgs.).

Bar-Cohen, et al. "*An Ultrasonic Sampler and Sensor Platform for In-situ Astrobiological Exploration*," Paper 5056-55, Proceedings of the SPIE Smart Structures Conference, San Diego, CA., Mar. 2-6, 2003 (9 pgs.).

Chang, et al. "*In-situ Rock Probing Using the Ultrasonic/Sonic Driller/Corer (USDC)*," Paper 5056-73, Proceedings of the SPIE Smart Structures Conference, San Diego, CA., Mar. 2-6, 2003 (7 pgs.).

Bar-Cohen, et al. "*Ultrasonic/Sonic Sampler and Sensor Platform for In-situ Planetary Exploration*," Proceedings of the International Conference on MEMS, NANO, and Smart Systems held in Banff, Alberta, Canada, Jul. 20-Jul. 23, 2003 (10 pgs.).

Bao, et al. "*Modeling and Computer Simulation of Ultrasonic/Sonic Driller/Corer (USDC)*," IEEE Transaction on Ultrasonics, Ferroelectrics and Frequency Control (UFFC), vol. 50, No. 9, (Sep. 2003), pp. 1147-1160 (13 pgs.).

Duran, et al. "*Life detection and characterization of subsurface ice and brine in the Mcmurdo dry valleys using an ultrasonic Gopher*," Third Mars Polar Science Conference (2003) (2 pgs.).

Blake, et al. "*Definitive mineralogical analysis of Martian rocks and soil using the Chemin XRD/XRF instrument and the USDC sampler*," Sixth International Conference on Mars (2003) (4 pgs.).

Chipera, et al. "*Use of an Ultrasonic-Sonic Driller-Corer to obtain sample powder for CHEMIN, a combined XRD-XRF instrument*," Lunar and Planetary Science XXXIV (2003) (2 pgs.).

Bar-Cohen, et al. "*Realtime sensing while drilling using the USDC and integrated sensors*," Eurosensors XVII Conference, Guimaraes, Portugal, Sep. 21-24, 2003 (4 pgs.).

Dragoi, et al. "*Laboratory Detection and Analysis of Organic Compounds in Rocks Using HPLC and XRD Methods*," Lunar and Planetary Science Conference, Houston, TX, Mar. 15-19, 2004 (2 pgs.).

Chipera, et al. "*Evaluation of rock powdering methods to obtain fine-grained samples for CHEMIN, a combined XRD/XRF instrument*," Lunar and Planetary Science Conference, Houston, TX, Mar. 15-19, 2004 (2 pgs.).

Sherrit, et al. "*Novel Horn Designs for Power Ultrasonics*," IEEE International Ultrasonics Symposium, UFFC, Montreal, Canada, Aug. 24-27, 2004 (4 pgs.).

Sherrit, et al. "*Resonance Analysis of High Temperature Piezoelectric Materials for Actuation and Sensing*," Proceedings of the SPIE Smart Structures Conference, San Diego, CA., SPIE vol. 5387-58, Mar. 14-18, 2004 (10 pgs.).

(56) References Cited

OTHER PUBLICATIONS

Chang, et al. "*Design and ana)ysis of ultrasonic horn for USDC*," Proceedings of the SPIE Smart Structures Conference, San Diego, CA., SPIE vol. 5388-34, Mar. 14-18, 2004 (7 pgs.).
Bar-Cohen, et al. "*Subsurface Ice and Brine Sampling Using an Ultrasonic/Sonic Gopher for Life Detection and Characterization in the McMurdo Dry Valley*" Proceedings of the SPIE Smart Structures Conference San Diego, CA., SPIE vol. 5388-32, Mar. 14-18, 2004 (9 pgs.).
Sherrit, et al. "*Efficient electromechanical network model for wireless acoustic-electric feed-throughs*," Proceedings of the SPIE Smart Structures Conference San Diego, CA., SPIE vol. 5758-44, Mar. 7-10, 2005 (11 pgs.).
Sherrit, et al. "*Smart material/actuator needs in extreme environments in space*," Proceedings of the SPIE Smart Structures Conference San Diego, CA., SPIE vol. 5761-48, Mar. 7-10, 2005 (12 pgs.).
Badescu, et al. "*Integrated modeling of the Ultrasonic/Sonic Drill/Corer—Procedure and analysis results*," Proceedings of the SPIE Smart Structures Conference San Diego, CA., SPIE vol. 5764-37, Mar. 7-10, 2005 (11 pgs.).
Badescu, et al. "*Adapting the Ultrasonic/Sonic Driller/Corer for walking/climbing robotic applications*," Proceedings of the SPIE Smart Structures Conference San Diego, CA, SPIE vol. 5764-37, Mar. 7-10, 2005 (9 pgs.).
Chang, et al. "*Design and analysis of ultrasonic horn for USDC (Ultrasonic/Sonic Driller/Corer)*," Proceedings of the SPIE Smart Structures Conference San Diego, CA., SPIE vol. 5388-34, Mar. 14-18, 2004 (7 pgs.).
Bar-Cohen, et al. "*The Ultrasonic/Sonic Driller/Corer (USDC) as a subsurface drill, sampler, and lab-on-a-drill for planetary exploration application*," Proceedings of the SPIE Smart Structures Conference San Diego, CA., SPIE vol. 5762-22, Mar. 7-10, 2005 (8 pgs.).
Chang, et al. "*Design and Analysis of ultrasonic actuator in consideration of length-reduction for a USDC (Ultrasonic / Sonic Driller / Corer)*," Proceedings of the SPIE Smart Structures Conference, San Diego, CA., SPIE vol. 5762-10, Mar. 7-10, 2005 (8 pgs.).
"*NASA Develops a Drill for the Future*," Apr. 12, 2000 Press Release for the Media Relations Office of the Jet Propulsion Laboratory, California Institute of Technology (2 pgs.).
"*NASA Develops a Drill for the Future*," Apr. 12, 2000 Press Release for the National Aeronautics and Space Administration (NASA) (2 pgs.).

* cited by examiner

ULTRASONIC/SONIC JACKHAMMER

CROSS-REFERENCE TO RELATED APPLICATIONS

This application claims priority to and the benefit of U.S. provisional patent application Ser. No. 60/765,153, filed Feb. 3, 2006, which application is incorporated herein by reference in its entirety.

STATEMENT REGARDING FEDERALLY SPONSORED RESEARCH

The invention described herein was made in the performance of work under a NASA contract, and is subject to the provisions of Public Law 96-517 (35 USC 202) in which the Contractor has elected to retain title.

FIELD OF THE INVENTION

The invention relates generally to devices that utilize ultrasonic and/or sonic vibrations, and more specifically to devices that use such vibrations for impact, probing, analysis or exploration purposes.

BACKGROUND OF THE INVENTION

Jackhammers are often used to open up or fracture a hard surface, such as concrete cement and rock formations. They are widely used in construction sites for preparation work, demolition and removal of concrete slabs, bricks and rocks as well as conducting maintenance or repair of plumbing or electrical wiring by electrical utility companies. Conventional jackhammers, also called pneumatic hammers, use compressed air to drive a metal piston up and down inside a cylinder. As the piston moves downward, it pounds the drill bit in the distal direction and into the target surface, e.g., the pavement, before reversing its direction and moving upward.

There are many drawbacks associated with the use of a pneumatic jackhammer that limit its applications. One of these drawbacks is the enormous acoustic noise that makes its use outside normal work hours nearly prohibitive in residential neighborhoods. Another drawback involves the violent back-pulsations during the operation of a pneumatic jackhammer, which require large axial forces and large holding torques during operation. In addition, the back-pulsations that propagate into the hand and body of the operators can cause severe damage and pose serious work hazards. Reported incidents include the dislocation and extraction of dentures from the operators' mouths. The cutting action by a pneumatic jackhammer is indiscriminate and every object it encounters along its path will be damaged. In utilities maintenance work, for example, this drawback becomes critical since it is imperative for workers to avoid damaging wires, plumbing conduits, reinforcement rebar and other fixtures.

These and other drawbacks such as high power consumption not only limit the conventional jackhammer's use in construction and utility maintenance, but also in medical surgeries, robotic operations, archeology, and geological explorations including space expeditions. Specifically for space expeditions, since many planets or other celestial bodies do not have as large an atmospheric pressure as is present on the Earth, it would be difficult to produce the type of pneumatic forces that are generated on the Earth to drive a conventional jackhammer. Therefore, the need for a new kind of jackhammer is widely felt across many industries and research fields.

SUMMARY OF THE INVENTION

The present invention provides an apparatus aimed at providing fracturing impact that spares flexible structures by the use of ultrasonic and sonic vibrations. In one aspect, the invention relates to an apparatus that includes a piezoelectric actuator configured to generate vibrations at a resonance ultrasonic frequency, and a solid impactor configured to be displaced by the vibrations generated by the piezoelectric actuator for causing structural breakage in a target. The actuator of the apparatus may include a backing and a piezoelectric stack that are held in compression by a mechanical element. The apparatus may further include one or more horns for amplifying the vibrations generated by the actuator. In an embodiment, at least a portion of the impactor tapers towards its distal end.

In one feature, the impactor is rigidly connected to the actuator such that the impactor vibrates at substantially the same ultrasonic frequency as the actuator, e.g., at a frequency between about 20 kHz and about 40 kHz. In one embodiment, the impactor is also interchangeable with at least another impactor.

In another feature, the apparatus of the invention also has a mass configured to oscillate between the actuator and the impactor, such that the impactor vibrates at a frequency lower than the ultrasonic frequency of the actuator, e.g., between about 5 kHz and about 10 kHz.

In still another feature, the housing that encloses the actuator remains substantially motionless during operation of the apparatus.

In one further feature, the apparatus of the invention further includes a sensor in physical contact with the impactor, the sensor configured to measure properties of an object in contact with the impactor. In one embodiment, the apparatus further includes a control system configured to receive signals from the sensor.

In a second aspect, the invention relates to an apparatus that includes an actuator configured to generate vibrations, an impactor configured to be displaced by the vibrations generated by the actuator, and a handle configured to remain substantially motionless during operation of the apparatus. In one embodiment, the actuator is configured to generate vibrations at an ultrasonic frequency, and the handle is rigidly connected to a nodal plane of the actuator.

In another aspect, the invention relates to an apparatus that includes:

a piezoelectric actuator configured to generate vibrations at an ultrasonic frequency;

an impactor; and a mass configured to oscillate between the actuator and the impactor, the mass having a selected magnitude such that it causes the impactor to vibrate at a frequency lower than the ultrasonic frequency.

In one embodiment, the impactor vibrates at an operating frequency that is sonic.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

The present invention provides a new type of jackhammer that utilizes ultrasonic and/or sonic vibrations to power the impacting bit for fracturing relatively brittle surfaces such as rocks and concrete. The new jackhammer disclosed herein uses a hammering mechanism that fractures brittle structures without causing damage to embedded flexible/ductile materials and structures. Further, the new jackhammer generates minimal back-pulsation that propagates back onto the mounting fixture, and requires little axial force or holding torque. As a result, it enables uses in conjunction with lightweight platforms such as those provided by certain robots and rovers in space missions, and also eliminates risks of injury to the operator. The present invention provides embodiments where the handle or the casing of the jackhammer remains virtually vibration-free during operation. Furthermore, apparatuses of the invention are significantly quieter than pneumatic systems, allowing uses in residential areas even at late hours or weekends while minimally perturbing the neighborhood. In particular, the invention provides jackhammer embodiments that make sounds inaudible to ordinary human ears, i.e., of ultrasonic frequencies.

Figure 1:
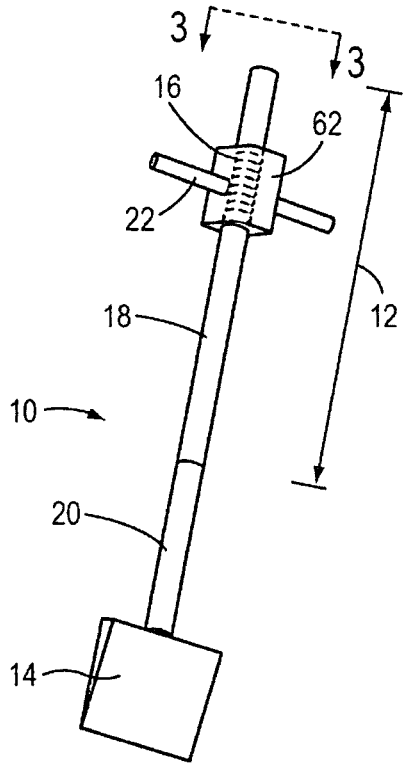
FIG. 1 illustrates a perspective view of basic embodiment of the ultrasonic/sonic jackhammer according to the invention.

Referring to FIG. 1, a basic setup for the present invention is now described. In one embodiment, an ultrasonic/sonic apparatus 10 is provided as a new generation of jackhammer. The apparatus 10 includes an actuator 12 for pulse generation, and an impactor 14 at the distal end of the apparatus for fracturing a target. The actuator is an ultrasonic transducer that typically includes a backing (not shown), a piezoelectric stack 16 and a horn 18 that amplifies the displacement generated by the stack. The piezoelectric stack 16 is capable of generating vibrations at an ultrasonic frequency. According to one feature of the invention, a free-oscillating mass is optionally provided to oscillate between the actuator 12 and the impactor 14 in order to reduce the frequencies of impacts by the apparatus. In the particular embodiment illustrated in FIG. 1, the optional mass 30 resides inside a cylindrical housing 20, but is not visible in FIG. 1. The impactor 14 is the part that delivers impact into the target. It can be made of any material with sufficient stiffness such as metals and ceramics, and can assume a variety of shapes such as those resembling a drilling bit. Typically, the impactor is solid. In a preferred embodiment, it resembles the shape of a chisel with sides tapering toward its distal extremity. A pair of handles 22 is optionally provided. In the embodiment shown in FIG. 1, the handles 22 are mounted to a housing 62 that encloses the piezoelectric stack 16.

Figure 2:
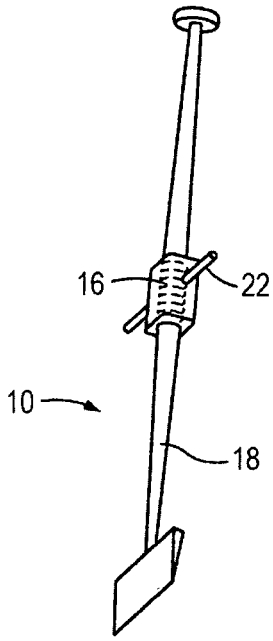
FIG. 2 illustrates a perspective view of an alternative embodiment of the invention where the handles are disposed at a more weight-balanced position.

FIG. 2 illustrates an alternative embodiment where the piezoelectric stack 16, which constitutes a large portion of the weight of the apparatus 10, has been moved towards the middle of the apparatus 10 such that the handles 22 outside the stack are positioned at a more weight-balanced spot. As shown in FIG. 2, the horn 18 can include a tapering rod for effective amplification of the vibrations.

Figure 3:
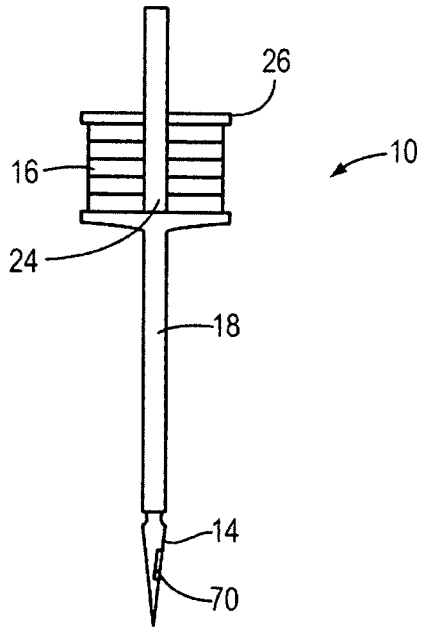
FIG. 3 illustrates a cross-sectional view of the embodiment illustrated in FIG. 1 along the lines 3-3.

Referring to FIG. 3 where a cross-sectional view of the apparatus 10 of the invention is provided, the actuator is driven at the resonance frequency of the piezoelectric stack 16, and one or more stress bolts 24 hold the stack in compression to prevent fracture during operation. The power supply is not specifically shown here, and can be a battery or AC source. As is well known, a piezoelectric material can convert an applied electrical field into a mechanical change in dimension. For electric fields applied at high frequency, a piezoelectric material can produce a change in dimension (or a vibration) at a correspondingly high frequency. To operate large impactors, a high power piezoelectric actuator is used. The backing 26 helps to maintain forward propagation of vibrations generated by the actuator. The horn 18 amplifies the vibrations introduced by the stack 16 as long as the interface area between the stack 16 and the horn 18 is larger than the interface area between the horn 18 and the impactor 14. To that end, the horn 18 is preferred to be stepped, but it can also be of other geometries including tapered or exponential. The stack 16, the horn 18, and the impactor 14 may be coupled to one another in any conventional manner. In one embodiment, the impactor 14 and the horn 18 are manufactured as one integral piece. The stack 16 comprises a plurality of piezoelectric segments each of which is disposed between two electrodes. The driving field may be applied as an electrical potential between the two electrodes disposed on each side of a piezoelectric segment. In this manner, an appreciable resultant response can be obtained using a relatively low potential across any individual piezoelectric segment.

In operation, the impactor 14 vibrates at ultrasonic or sonic frequencies. In an embodiment, the impactor 14 is rigidly connected to the horn 18. As a result, it vibrates at substantially the same ultrasonic or sonic frequency as the actuator, e.g., between about 20 kHz and about 40 kHz. In another embodiment, the impactor 14 is connected to the horn 18 in a manner that the impactor can be removed and interchanged with another impactor. Impact delivered by the impactor tends to comprise a small displacement but at a higher frequency, and causes structure breakage in relatively brittle targets such as ice, bricks, and rocks. The impact does not cause substantial damage to relatively flexible or ductile structures including wood, plastic and metal structures. Neither does the impact hurt soft human tissues upon momentary contact.

Figure 4:
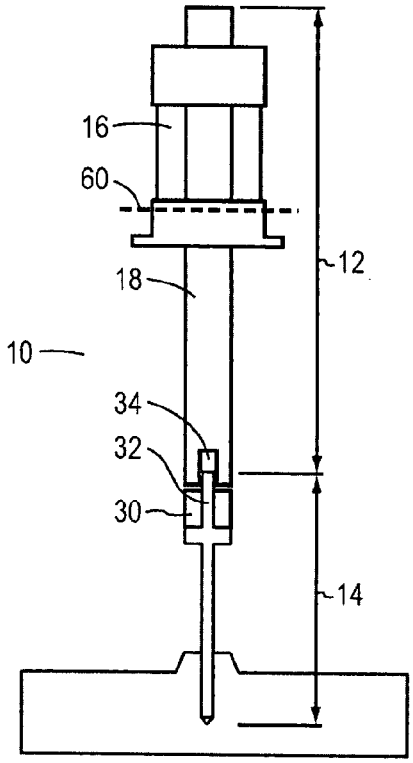
FIG. 4 illustrates a cross-sectional view of one embodiment of the ultrasonic/sonic jackhammer according to the invention, where a free-oscillating mass is utilized.

Referring now to FIG. 4, according to one aspect of the invention, the ultrasonic apparatus 10 can also incorporate a free-oscillating mass 30 that bounces between the tip of the horn 18 and the chiseling impactor 14. As a result, the impactor 14 vibrates at a frequency lower than the resonance frequency of the actuator, typically at sonic frequencies, although the mass and the impactor can be selected of sufficiently light-weight structures and the gap between the mass and the impactor fixed so that the impactor may still vibrates at an ultrasonic frequency albeit lower than the original one emitted by the actuator. In one embodiment, the impactor vibrates at an operating frequency between about 5 kHz and about 10 kHz. The impact of the free-oscillating mass creates stress pulses that propagate to the interface between the impactor and the target surface onto which the jackhammer is placed. The target, e.g., a rock, fractures in the impact location when its ultimate strain is exceeded at the rock/impactor interface.

Figure 5:
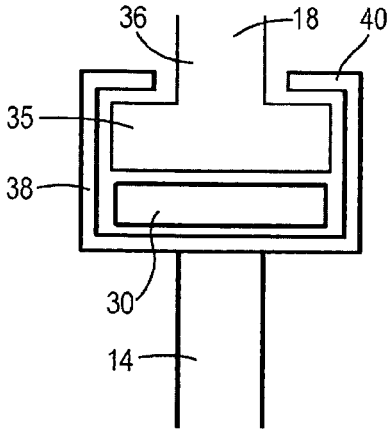
FIG. 5 is a cross-sectional view of part of the device showing schematically one way to configure the horn, the free-oscillating mass and the impactor, according to one embodiment of the invention.

U.S. Pat. No. 6,617,760 issued to Peterson et al. describes details regarding the free-oscillating mass and is incorporated herein by reference in its entirely. There are many ways to incorporate the free-oscillating mass between the ultrasonic actuator and the impactor. Referring to FIG. 4, the impactor 14 has a stem 32 that is slidingly inserted inside a bore 34 at the tip of the horn 18. The free-oscillating mass 30 is a circular or an annular element resembling a donut with an opening to fit around the impactor stem 32. The free-oscillating mass is therefore confined to oscillate along the impactor stem 32. As another example, referring now to FIG. 5, the free-oscillating mass 30 in this case is solid and is disposed between the tip 35 of the horn 18 and the impactor 14. Specifically, the horn tip 35 has a diameter larger than the portion 36 leading to the tip, and the stem of the impactor 14 has a cylindrical housing 38 that is topped with a shoulder 40 that makes the opening of the housing 38 smaller than the diameter of the horn tip 35 such that it won't slip out. As a result, the free-oscillating mass 30 is trapped in between the horn and the impactor.

Figure 6:
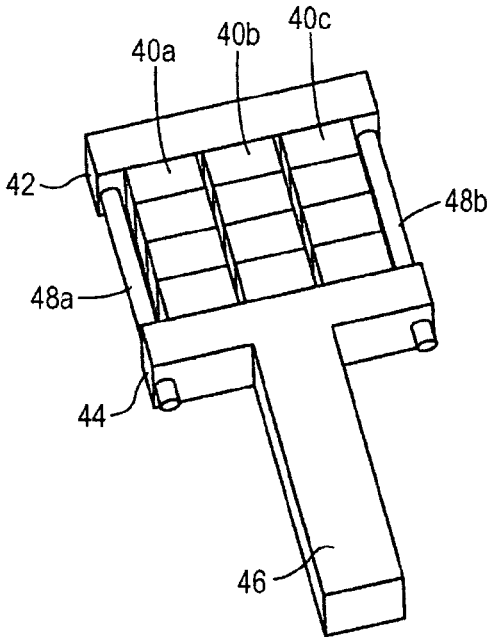
FIG. 6 is a perspective view of one embodiment of the invention with multiple piezoelectric stacks.

Regardless whether the ultrasonic/sonic jackhammer uses the free-oscillating mass or not, it can use multiple piezoelectric stacks and/or multiple horns. Referring to FIG. 6, these multiple piezoelectric stacks, in this particular example, three of them (40*a*, 40*b* and 40*c*), are disposed side by side in between the backing 42 and the top portion 44 of the horn 46. Two mechanical elements, e.g., stress bolts 48*a* and 48*b*, span the same length and hold the stacks in compression. As described earlier, the horn 46 amplifies the power—in this case, by virtue of having a much wider cross sectional area on the top portion 44 than the rest of it. Each of the multiple piezoelectric stacks 40*a*-40*c* is substantially identical and, in operation, driven to vibrate at the same resonance frequency. The power of all the piezoelectric stacks is combined and transmitted to the impactor through the horn and the optional free-oscillating mass.

Figure 7A:
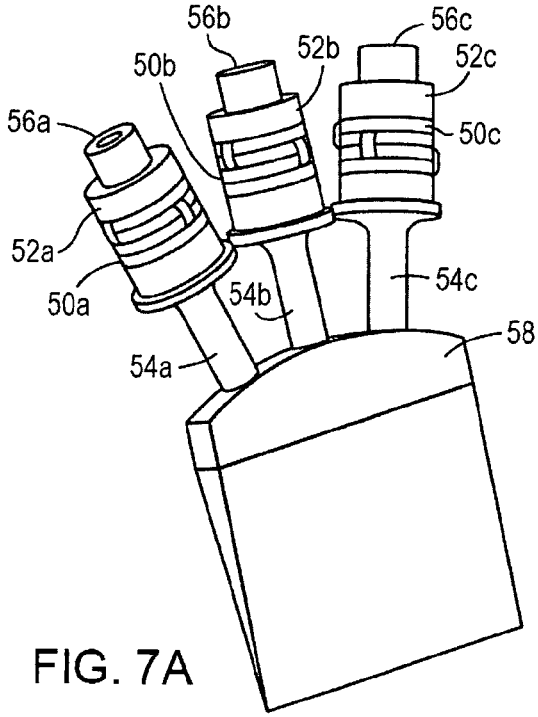
FIG. 7A is a perspective view of one embodiment of the invention with multiple horns.
Figure 7B:
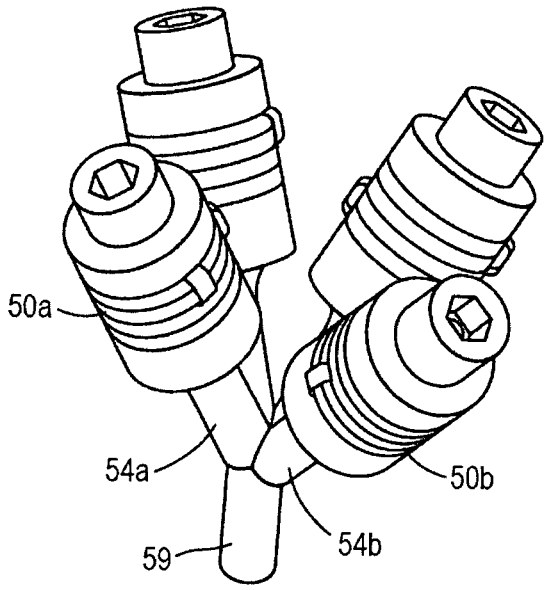
FIG. 7B is a perspective view of one embodiment of the invention with multiple input paths for the horn.

FIG. 7A illustrates a multi-horn configuration with multiple input paths for the reception of ultrasonic vibrations. Specifically in the illustrated embodiment, three piezoelectric stacks (50*a*, 50*b* and 50*c*) are each compressed between a backing (52*a*, 52*b* and 52*c*) and a horn (54*a*, 54*b* and 54*c*) by a stress bolt (56*a*, 56*b* and 56*c*). All of the horns (54*a*, 54*b* and 54*c*) converge into a single impactor 58, combining the energy from the multiple piezoelectric stacks (50*a*, 50*b* and 50*c*). Preferably, each horn is stepped to increase the impact. FIG. 7B illustrates another configuration that serves a similar purpose. In this case, a forked or branched horn is provided with multiple input energy paths (two of the four are labeled as 54*a* and 54*b*) that converge into one single output path 59, before connecting to the impactor (not shown). Each fork (54*a*, 54*b* and so on) of the horn has a geometry similar to its counterpart in FIG. 7A, and is stepped to amplify vibration generated upstream by the piezoelectric stacks (50*a*, 50*b* and so on).

As shown in FIG. 7A, in one embodiment of the invention, all the horns (54*a*-54*c*) attach or contact the impactor 58 at a curved, upper surface of the impactor 58. This curved surface orients various horns (54*a*-54*c*) to angle toward each other rather than to run parallel to each other. The energy from these horns (54*a*-54*c*), which are angled with respect to each other, combine inside the impactor 58. As shown in FIG. 7B, in another embodiment of the invention, each fork (54*a*, 54*b* and so on) of the forked or branched horn is angled relative to the others (rather than being oriented parallel to another fork). The multiple forks meet at an intersecting location, where power provided by each fork is combined with that of the others so as to flow through the remainder of the forked horn.

Referring back to FIG. 4, the ultrasonic actuator 12 has a nodal plane 60 where there is substantially no vibration when the actuator is being driven to vibrate at its resonance frequency. This can be understood by considering that at any instant, there are vibrations going in one direction on one side of the plane and vibrations going in the other direction on the other side and they cancel each other out at the nodal plane. This neutral nodal plane 60 is typically found in between the bottom of the piezoelectric stack 16 and the top of the horn 18, or somewhere proximate. Referring back to FIG. 1, in a preferred embodiment, the outside housing 62 for the ultrasonic/sonic jackhammer is mounted to the actuator at its nodal plane 60 so that the housing remains substantially motionless even during operation. Handles 22 can be further affixed to the housing 62 so that the handles also remain substantially motionless during operation, eliminating potential hazard for the operator and enabling integration with lightweight platforms and robots. Of course, the handles can be affixed directly to the actuator, and as long as they are somehow rigidly connected to the nodal plane of the actuator, the handles will remain substantially motionless during operation. In addition, the attachment of handles to a nodal plane, or to a housing connected to the actuator at a nodal plane will eliminate the loss of energy associated with motion of the handles. If the handles do not move, no mechanical energy will flow through them to some object or some person holding the handles.

The ultrasonic/sonic jackhammer can be used to screen the drilling location benefiting from the inherent probing capability of the piezoelectric actuator to operate as a sounding mechanism and as a mechanical impedance analyzer. A variety of sensors 70 (FIG. 3) can be embedded in or disposed on the impactor, i.e., in physical contact with the impactor, to measure mechanical and electrical properties of the object that is in contact with the impactor. A control system is used to receive signals from the sensors and to produce valuable information on the soil or rock that is being worked on. The jackhammer system can further incorporate remote sensors, such as one or more accelerometers positioned away from the point of contact by the impactor for analyzing elastic wave changes in the medium that is being worked on. U.S. Pat. No. 6,863,136 issued to Bar-Cohen et al. describes details of the use of sensors including the use of sensor ceramics in the ultrasonic actuator, and is incorporated herein by reference in its entirety. These probing capabilities and the ability to carry sensors on the impactor can be used to optimize the drilling or exploration plan and to conduct in-situ data acquisition and analysis.

Figure 8A:
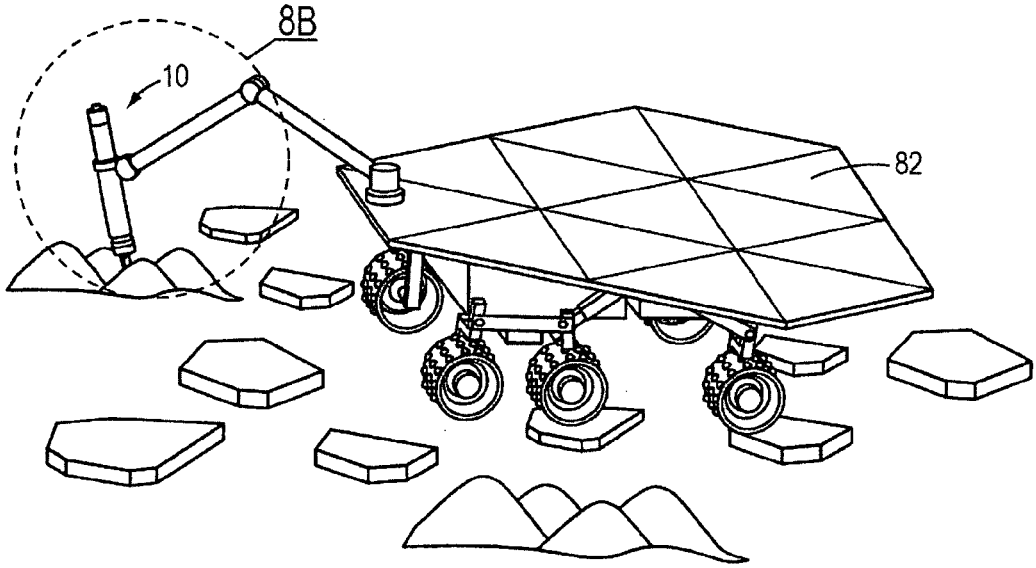
FIG. 8A is a perspective view of a robotic system equipped with an apparatus of the invention.
Figure 8B:
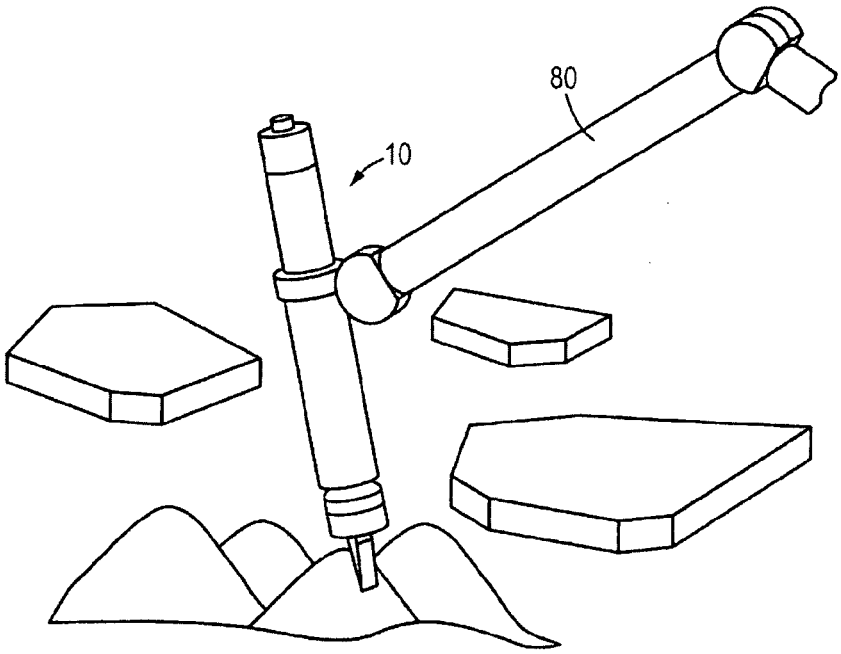
FIG. 8B is a close-up view of a portion of the robotic system of FIG. 8A, showing the jackhammer system of the invention.
Figure 9:
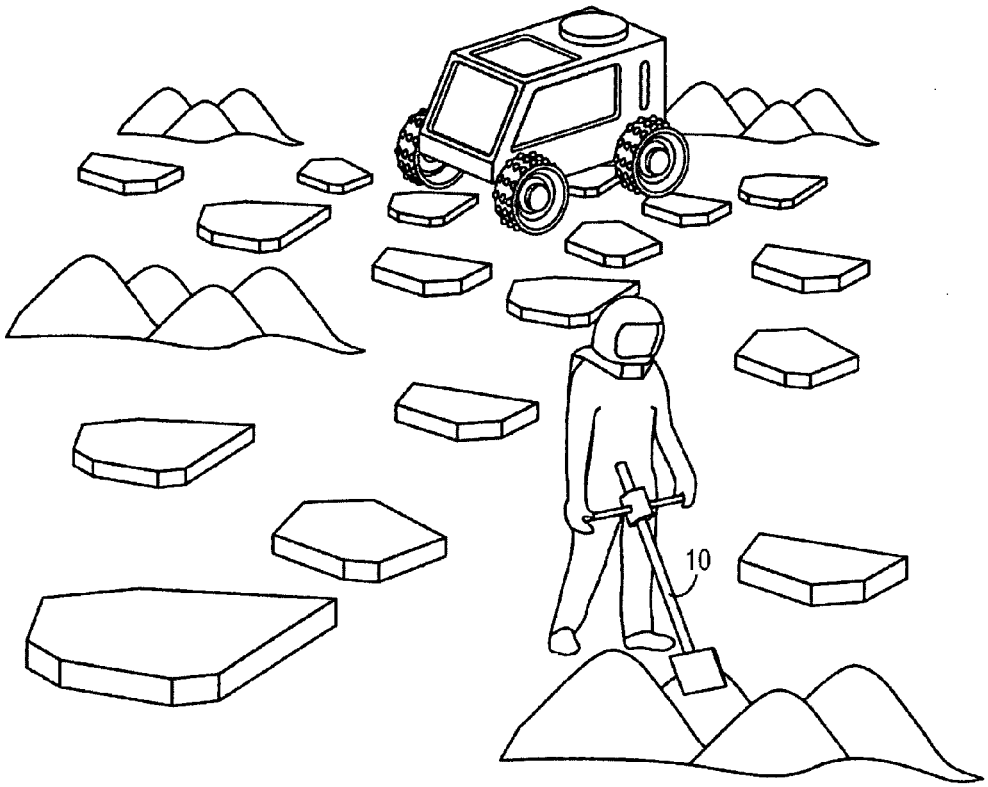
FIG. 9 is a perspective view of an envisioned application of the invention in space exploration.

Referring to FIGS. 8A and 8B, since the new jackhammer 10 does not introduce major back propagated vibrations onto the mounting fixtures, it can be mounted onto a robotic arm 80 and operated automatically from a rover 82 in planetary in-situ tasks. This application is shown graphically in FIG. 8A, with a close-up view of the jackhammer mounted on a robotic arm shown in FIG. 8B. Specifically, the ultrasonic/sonic jackhammer is shown to be used for cleaving fresh surfaces of rocks. Another potential application for the new jackhammer 10 is future construction and development of infrastructures as shown graphically in FIG. 9. If men want to eventually inhabit planets such as Mars, the ability to construct underground water reservoirs, housing, roads, and whatever men are accustomed on the Earth is critical. Given the fact that the atmospheric pressure on Mars is about one hundredth of the level on earth it would be difficult to produce the type of pneumatic forces that are generated on earth, and the disclosed ultrasonic/sonic jackhammer offers an important alternative.

While the present invention has been particularly shown and described with reference to the structure and methods disclosed herein and as illustrated in the drawings, it is not confined to the details set forth and this invention is intended to cover any modifications and changes as may come within the scope and spirit of the following claims.

What is claimed is:

1. An apparatus that combines power from multiple piezoelectric transducer units into a single impactor for breaking a hard surface on a target, comprising:

a piezoelectric actuator configured to generate vibrations only in the axial direction of the actuator and directly from electric input at a resonance frequency, the piezoelectric actuator comprising a plurality of separate units, each unit comprising a piezoelectric stack compressed between a backing and a horn, wherein all the units are of substantially identical length and are arranged in a lateral dimension, their horns angled with respect to each other so as to converge, causing their power to combine when each of the plurality of units are driven to vibrate at substantially the same frequency; and a solid chisel-like impactor, with at least two opposing sides tapering toward and terminating at a distal linear edge, and configured to be displaced by the axial vibrations generated by the piezoelectric actuator for causing structural breakage in a target, wherein the impactor is rigidly connected to the actuator through the horns of the piezoelectric units such that the impactor vibrates at substantially the same resonance frequency as the actuator.

2. The apparatus of claim 1, wherein the impactor is also interchangeable with at least another impactor.

3. The apparatus of claim 1, wherein the impactor vibrates at a frequency between about 20 kHz and about 40 kHz.

4. The apparatus of claim 1, further comprising:

a mass configured to oscillate between the actuator and the impactor, such that the impactor vibrates at a frequency lower than said ultrasonic frequency.

5. The apparatus of claim 4 wherein the impactor vibrates at an operating frequency between about 5 kHz and about 10 kHz.

6. The apparatus of claim 1 wherein each piezoelectric stack is held in compression by a mechanical element.

7. The apparatus of claim 6, wherein the actuator comprises a plurality of piezoelectric stacks, all of which being configured to operate at the same frequency.

8. The apparatus of claim 6 wherein the actuator further comprises a horn for amplifying vibrations generated by the piezoelectric stacks.

9. The apparatus of claim 8 wherein the horn is stepped.

10. The apparatus of claim 1 wherein the actuator further comprises a forked horn with multiple input path for the application of the vibration and one output path for combining the energy onto the impactor.

11. The apparatus of claim 10 wherein each input path of the energy from the horn is stepped.

12. The apparatus of claim 1, further comprising a handle configured to remain substantially motionless during operation of the apparatus.

13. The apparatus of claim 12, wherein the handle is rigidly connected to a nodal plane of the actuator.

14. The apparatus of claim 1, further comprising a housing that encloses at least the actuator, wherein the housing is configured to remain substantially motionless during operation of the apparatus.

15. The apparatus of claim 1 wherein the impactor comprises a stem that is coupled to the actuator, and the mass has an opening defined therein through which the impactor stem passes such that the mass is confined to oscillate along the impactor stem.

16. The apparatus of claim 1, further comprising a sensor in physical contact with the impactor, the sensor configured to measure properties of an object in contact with the impactor.

17. The apparatus of claim 16, further comprising a control system configured to receive signals from the sensor.

18. The apparatus of claim 1, wherein each horn is stepped.

19. The apparatus of claim 1, wherein each horn is connected to the same impactor.

20. The apparatus of claim 1 comprising a plurality of separate horns, each associated with a different actuator unit.

21. The apparatus of claim 1 capable of being used as a jackhammer.

22. The apparatus of claim 1 with breaking ability comparable to a pneumatic jackhammer but weighing substantially less than a pneumatic jackhammer.

23. The apparatus of claim 1 with breaking ability comparable to a pneumatic jackhammer but being significantly quieter than a pneumatic jackhammer.

24. The apparatus of claim 1 wherein the single point where the horns of the plurality of piezoelectric units converge is in the impactor.

25. The apparatus of claim 1 wherein the single point where the horn of the plurality of piezoelectric units converge is in turn rigidly joined to the impactor.

26. An apparatus that combines power from multiple piezoelectric transducer units into a single impactor for breaking a hard surface on a target, comprising:

a piezoelectric actuator configured to generate vibrations only in the axial direction of the actuator and directly from electric input at a resonance frequency, the actuator comprising a plurality of separate units, each unit comprising a piezoelectric stack compressed between a backing and a horn, wherein all the units are of substantially identical length and are arranged in a lateral dimension, their horns angled with respect to each other so as to converge, causing their power to combine when the plurality of units are driven to vibrate at substantially the same frequency; and a solid and removable impactor configured to be displaced by the axial vibrations generated by the piezoelectric actuator for causing structural breakage in a target, wherein the impactor is rigidly connected to the actuator through the horns of the piezoelectric units such that the impactor vibrates at substantially the same resonance frequency as the actuator.

27. The apparatus of claim 26, wherein each horn is stepped.

28. The apparatus of claim 26, wherein each horn is connected to the same impactor.

29. The apparatus of claim 26, wherein each horn is configured to operate at the same frequency.

30. The apparatus of claim 26, further comprising a handle configured to remain substantially motionless during operation of the apparatus.

31. The apparatus of claim 30, wherein the handle is rigidly connected to a nodal plane of the actuator.

32. The apparatus of claim 26, further comprising a housing that encloses at least the actuator, wherein the housing is configured to remain substantially motionless during operation of the apparatus.

33. The apparatus of claim 26, further comprising a sensor in physical contact with the impactor, the sensor configured to measure properties of an object in contact with the impactor.

34. The apparatus of claim 26 capable of being used as a jackhammer.

35. The apparatus of claim 26 with breaking ability comparable to a pneumatic jackhammer but weighing substantially less than a pneumatic jackhammer.

36. The apparatus of claim 26 with breaking ability comparable to a pneumatic jackhammer but being significantly quieter than a pneumatic jackhammer.

* * * * *